US007776208B2

(12) United States Patent
Guo

(10) Patent No.: US 7,776,208 B2
(45) Date of Patent: Aug. 17, 2010

(54) INTEGRATION OF GASIFICATION, HYDROCARBON SYNTHESIS UNIT, AND REFINING PROCESSES

(75) Inventor: C.J. Guo, Exton, PA (US)

(73) Assignee: L'Air Liquide - Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 1083 days.

(21) Appl. No.: 10/957,457

(22) Filed: Oct. 1, 2004

(65) Prior Publication Data

US 2005/0150820 A1 Jul. 14, 2005

Related U.S. Application Data

(60) Provisional application No. 60/535,786, filed on Jan. 12, 2004.

(51) Int. Cl.
*C10G 45/00* (2006.01)

(52) U.S. Cl. ..... 208/370; 208/46; 208/950; 518/700; 518/702; 518/726; 60/775; 48/197 R

(58) Field of Classification Search ..... 48/197 R; 60/775; 208/370, 46, 950; 518/726, 700, 518/702

See application file for complete search history.

(56) References Cited

U.S. PATENT DOCUMENTS 4,946,477 A 8/1990 Perka et al.
5,715,971 A 2/1998 Morand
5,865,023 A * 2/1999 Sorensen et al. ..... 60/775
6,282,880 B1 9/2001 Wallace et al.
6,303,089 B1 10/2001 Wallace et al.
6,409,912 B1 6/2002 Wallace et al.
6,416,568 B1 7/2002 Wallace et al.
6,596,780 B2 7/2003 Jahnke et al.
2002/0004533 A1 1/2002 Wallace et al.
2003/0041518 A1 * 3/2003 Wallace et al. ..... 48/197 R

OTHER PUBLICATIONS

D. Gray and G. Tomlinson, "*Potential of Gasification in the U.S. Refining Industry*" U.S. Department of Energy Contract No. DE-AC22-95PC95054, Jun. 1, 2000.

* cited by examiner

*Primary Examiner*—Glenn Caldarola
*Assistant Examiner*—Prem C. Singh
(74) *Attorney, Agent, or Firm*—Christopher J. Cronin

(57) ABSTRACT

This disclosure discusses integrating syngas streams with refinery hydrotreators, synthetic hydrocarbon gas to liquid (GTL) processes, and power generation units (such as combined cycle units) to efficiently use hydrogen contained in the syngas produced from heavy hydrocarbons (pet coke, residues, oil, etc.). Membrane separation and pressure swing adsorption is used to separate components of syngas and feed them to refineries, GTL units, and power/steam generation units. Hydrogen-rich refinery purge is used to raise the H2/CO ratio of syngas. A hydrogen-enriched syngas is produced with an H2/CO ratio favorable for the production on synthetic hydrocarbons (greater than about 1.5 to about 2.0 or higher). Pure hydrogen is also produced in a PSA unit, to further raise the H2/CO ratio of the syngas and provide hydrogen feed for refinery hydrotreators and synthetic hydrocarbon units (such as methanol units).

7 Claims, 4 Drawing Sheets

INTEGRATION OF GASIFICATION, HYDROCARBON SYNTHESIS UNIT, AND REFINING PROCESSES

CROSS-REFERENCE

This application is related to and claims the benefit of U.S. provisional application No. 60/535,786 filed Jan. 12, 2004, the entire contents of which are incorporated herein by reference.

TECHNICAL FIELD

This invention relates to integration of refinery hydroprocessing units, heavy hydrocarbons (pet coke, resides oil, etc) gasification units, and GTL plants through separation means that include membrane permeation, adsorption and absorption to effectively utilize H2 containing and syngas streams at reduced expenditures. The advantages are full utilization of H2 and other gases as chemical feedstocks or power generation fuel while satisfying needs for syngas composition in the GTL plant and H2 purity in the refinery hydroprocessing units. The integration of these operations also significantly reduces number of separation units required.

BACKGROUND

As refiners are regulated towards producing cleaner, lower-sulfur transportation fuels from heavier or poorer-quality crudes, amount of pet coke and refinery resides generated is increasing but their market decreasing. At the same time, the low sulfur product specifications also drive a significant increase in demand for hydrogen. A potentially economical option for a refiner is to use these heavy and low value hydrocarbon stocks to generate hydrogen and utilities (power and steam), either used by the refinery or sold in a deregulated electric power market. In addition, these hydrocarbon feedstocks can also be converted to sulfur-free liquids, such as transportation fuels, dimethyl ether (DME), methanol, via Fisher-Tropsch process. Upgraded F-T liquids are zero sulfur, paraffinic hydrocarbons that can be classified as ultra-clean transportation fuels and be used as a blending stock to assist refiners in meeting ultra low sulfur diesel specifications.

It was reported that there are 35 refineries in the US that have greater than 1,000 TPD Coking capacity (D. Gray and G. Tomlinson, "Potential of Gasification in the U.S. Refining Industry", U.S. Department of Energy Contract No.: DE-AC22-95PC95054, Jun. 1, 2000). A total of almost 95,000 TPD of Pet coke is produced in these 35 refineries. Total U.S. coke production for 1999 was 96,200 tons; therefore, these 35 refineries represent over 98 percent of production.

The key for the conversion of low-value feedstock to high value fuels is gasification. Integrated gasification combined cycle (IGCC) processes, as shown in U.S. Pat. No. 4,946,477, convert heavy refinery residue and/or coal into a mixture of H2 and CO (syngas) to produce power and/or steam, and optionally also produce hydrogen. "Combined Cycles" use both gas and steam turbine cycles in a single plant to produce electricity with high conversion efficiencies and low emissions. In an IGCC plant, coal or coke is gasified in a reaction vessel. The hot gaseous effluent from gasification (referred to as "raw syngas") is cooled, cleaned and, expanded through a gas turbine for power generation. Waste heat from the gas turbine and from gas cleaning and gasification processes is used to raise high-pressure steam for additional electricity generation.

Hydrocarbon synthesis units, or gas to liquid (GTL) units, convert syngas to useful synthetic hydrocarbon products. The term hydrocarbon synthesis unit, as used in this application, can be various processes known in the art for conversion of syngas into synthetic hydrocarbon products. The hydrocarbon synthesis units may comprise synthesis reactors, liquid/vapor separation systems, product upgrading units, such as hydrocracking, and/or other processes. Hydrocarbon synthesis processes may include Fischer-Tropsch (F-T) processes, or other gas to liquid processes (GTL), known to one skilled in the art.

Syngas produced from petcoke or coal is relatively deficient of H2, that is, the H2/CO ratio of the syngas is low (usually <1). This ratio is too low for the syngas to be utilized as a feed stocks to a F-T based GTL process. For instance, a F-T process based on certain catalyst, or a methanol production process requires a syngas with a H2/CO ratio of about 2.0. Either adding H2-rich stream to the syngas or removing H2 from the syngas can adjust the H2/CO ratio. It is desirable to develop processes that efficiently use heavier/poor quality feedstocks while still supplying higher H2/CO ratio syngas to hydrocarbon synthesis units.

Refineries use hydrotreating as a key step to produce low sulfur fuels, such as gasoline and diesel. Hydrotreators (hydrotreating reactors) treat the petroleum feedstock catalytically in the presence of an excess of hydrogen to remove sulfur, nitrogen, metals, etc, from the feed. Higher purity and partial pressure of hydrogen result in higher quality refinery products with the same reaction system. However, it is difficult to maintain the high purity levels of hydrogen in the hydrotreator due to a buildup of inert gases in the system. To remove the inert gases, a portion of the recycle gas is purged to continuously remove inert gases from the hydrotreating system. The hydrogen required by the reactions is supplied through a make up stream that usually has a high H2 content. The more make up stream is used, and the more recycle gas is purged, the higher the H2 purity in the hydrotreating reactor. Since the recycle gas is high in hydrogen content, purging will result in significant hydrogen losses to the process. Thus, it is desirable to reject non-hydrogen components in the purge-gas stream while recapturing the contained hydrogen. It is also desirable to extract value, such as the heating value, from the non-hydrogen components of the purge stream. A selective separation unit, such as a H2 selective membrane can achieve such objectives.

There are several important separation operations that are critical to achieve the conversion of the low value feedstocks to high value fuels, chemicals and power with very low emissions. These are dictated by the following characteristics of such an integrated complex:

- Syngas produced from heavy feedstocks has low H2/CO ratio (<1), too H2-lean to be used as a FT/GTL or methanol plant feed gas.
- Refinery hydroprocessing units need higher purity make-up H2 for improved efficiency in reaching low sulfur content in fuel products. At least a part of gaseous stream of these units need to be purified, including primarily sulfur removal, light hydrocarbon rejection and H2 purity upgrading.
- The inert or by-product gases from a GTL and a chemical production process need to be rejected while not losing valuable feed stock such as H2 and CO.
- Relatively high purity H2 is required for FT liquid upgrading via mild hydrocracking. Such H2 is not readily available from the heavy hydrocarbon gasification process.

Utilizing membrane and PSA separation schemes can achieve more efficient integration of IGCC, GTL and refining processes and saves on capital and operating expenditures related to various separation operations.

For refinery hydroprocessing units, an increased purge of recycle gas can be practiced by using a membrane permeator to only purge the light hydrocarbons, especially methane while not losing H2. For a GTL plant, a desired feed gas composition can be obtained by either removing H2 from raw syngas or by blending H2-rich gas, such as the gas from the membrane permeator, to the raw syngas.

For refining hydroprocessing unit and GTL product upgrading/hydrocracking units, higher purity H2 is provided. The high purity H2 make-up and increased purge allow a higher H2 partial pressure in the reactors, and therefore a better reaction process efficiency.

Cost for sulfur removal can be reduced by sharing an acid gas removal unit (AGR) between gasification and refining units.

Thus, it is desirable to develop processes that maximize production of high value liquids, minimizes the output of heavy residue while increasing hydrotreating efficiency of refinery hydroprocessing units (including hydrotreating and hydrocracking operations). Such objectives can be achieved by a rational utilization of H2 in a refinery with gasification and GTL units via gas separation using membrane and other means.

SUMMARY

The present invention is directed to a process that satisfies the need to increase refining hydroprocessing unit H2 purity, to maximize the desirable and environmentally acceptable product produced from pet coke, refinery residuals, and/or coal while extracting a maximum amount of residual value (such as heat value) from the unreacted components of the feedstock. This is accomplished in the present invention by integrating one or more refinery hydroprocessing units, a gasification unit (or syngas stream), a hydrocarbon synthesis unit (also called a GTL unit), and a utilities generation unit. The present invention utilizes the purge streams (preferably significantly increased over regular purge flow) from refinery hydrotreators or hydrocrackers, through a selective separation using a membrane, to raise the hydrogen concentration of the raw syngas from the gasification unit. The process also provides provisions to extract hydrogen from a portion of the raw syngas and use the extracted hydrogen as make-up hydrogen to the hydroprocessing units of the refinery, allowing the refinery to operate at higher hydrogen partial pressures, thus enhancing hydrotreating or hydrocracking process efficiency. The H2-lean streams, either from the membrane retentate or from the PSA tailgas are fed to a utilities generation unit to produce power and/or steam.

The process having features of the present invention may also comprise the steps of supplying a raw syngas and a purge stream from refinery hydroprocessing units to an acid gas removal (AGR) unit. The AGR unit strips out contaminants from its feed streams to produce a sulfur-free syngas, referred to herein as desulfurized syngas. A portion of the desulfurized syngas is fed to a syngas membrane separator to form an H2-enriched permeate stream and an H2-lean retentate stream. A portion of the H2-enriched permeate stream is then added to the desulfurized syngas to form a H2-enriched syngas with a H2/CO ratio needed for the hydrocarbon synthesis unit to produce synthetic hydrocarbons (typically liquids). Another portion of the H2-enriched permeate stream is optionally fed to a PSA unit, which then produces a substantially pure H2 stream. A portion of the substantially pure H2 stream may be sent to the refinery for use in the hydrotreating reactor as a make-up gas while another portion is fed to portions of the hydrocarbon synthesis unit, such as the synthesis unit's hydrocracker. The H2-lean retentate stream from the membrane separator and the combustible tail gas from the PSA unit are fed to a utilities generation unit to generate power and/or steam.

The process has the advantage of utilizing membrane and PSA separation schemes to achieve more efficient integration of IGCC, GTL plant, and refining processes, and save on capital and operating expenditures. In addition, high purity H2 is provided for refining hydroprocessing units. Furthermore, sulfur removal costs are reduced by sharing AGR facilities between gasification and refining units.

DESCRIPTION

The process of the present invention integrates one or more refinery hydroprocessing units (hydrotreaters or hydrocrackers), a syngas stream or gasification unit, a hydrocarbon synthesis unit, and a utilities generation unit to efficiently utilize low-purity H2 from refinery purge, and to convert low H2/CO raw syngas from the gasifier into high quality transportation fuels or other hydrocarbon products, and produce power and/or steam.

As used herein, the term "syngas" describes the gas comprising primarily carbon monoxide (CO) and hydrogen (H2) that is produces by a gasification process. Syngas is produced from hydrocarbon feedstocks by any of a number of processes known to those skilled in the art, such as steam methane reforming (SMR), autothermal reforming (ATR) and gasification (or partial oxidation). Preferred gasification processes convert heavy and solid hydrocarbon feedstocks with the use of oxygen. Typical raw materials used in gasification to produce syngas are coal, petroleum based materials (petroleum coke, and other refinery residuals) or materials that would otherwise be disposed of as waste.

Figure 1:
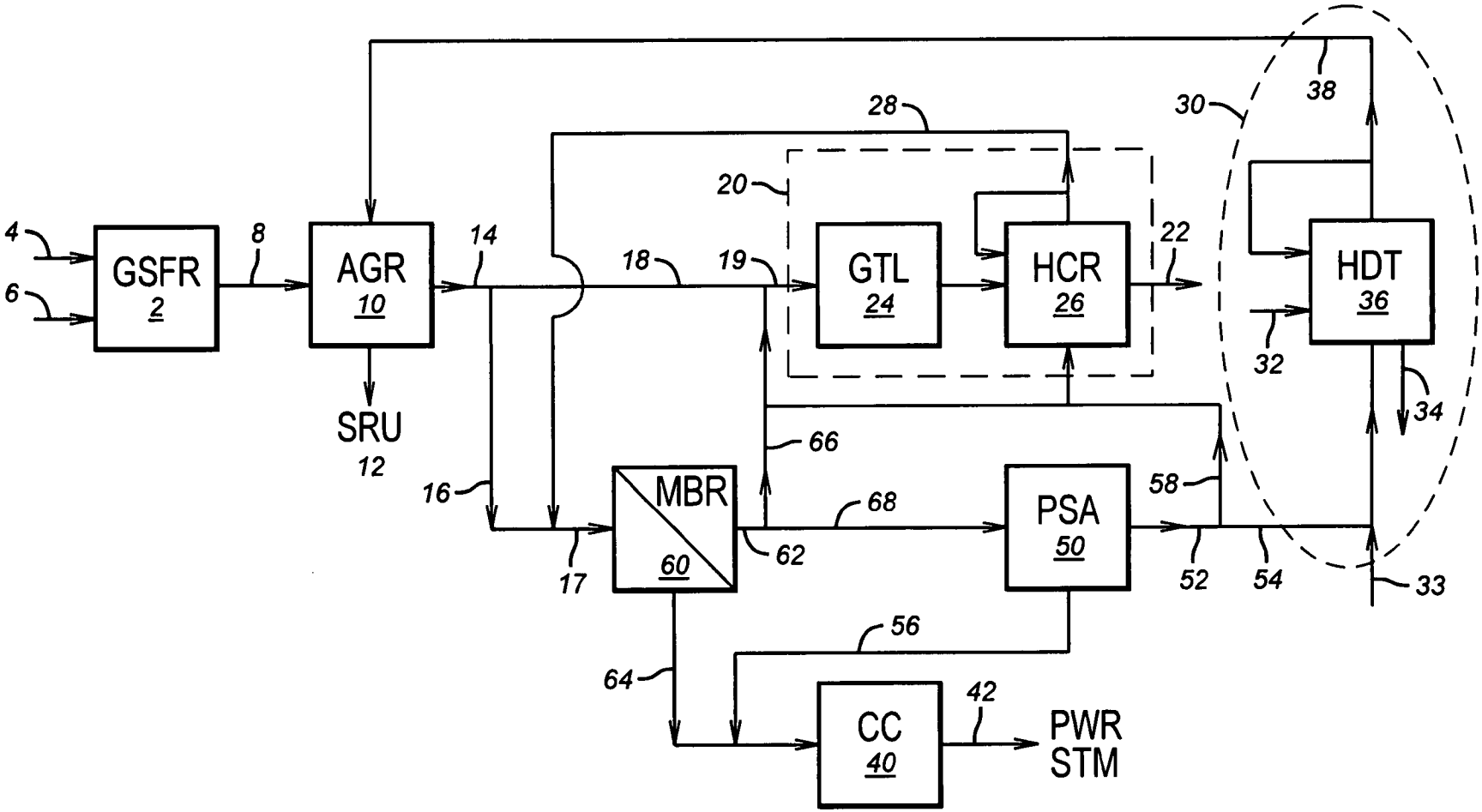
FIG. 1 is a diagram of one embodiment of the current invention.

Referring to FIG. 1, the feedstock (e.g., petcoke) is prepared and fed to the gasifier 2 in either dry or slurry form. The carbonaceous feed 4 reacts in the gasifier 2 with oxygen 6 at temperature and pressure conditions suitable for maximum formation of CO and H2 and minimization of CO2.

As used herein, the term "raw syngas" 8 describes the syngas produced by a gasification process before the sulfur compounds are removed. The raw syngas 8 of the current invention comprises predominantly hydrogen (H2) and carbon monoxide (CO). A preferred raw syngas contains about 20 to about 60 mole percent H2. Another preferred raw syngas contains about 25 to about 50 mole percent H2. Furthermore, the H2/CO ratio of the preferred raw syngas is less than 1.5, and in one preferred embodiment is less than 1.0. These ranges are not absolute and are subject to change with changing gasification feedstocks.

As used herein, the term acid gas removal unit (AGR) 10 describes the process and process equipment used to remove contaminants, primarily sulfur, from the raw syngas. The acid gas removal unit 10 may be any of various types of processes known to one skilled in the art, such as solvent based scrubbing processes based on chemical or physical absorption principles. The sulfur-concentrated stream from the acid gas removal unit 10 is sent to a sulfur removal unit (SRU) 12 for sulfur production.

As used herein, the term "desulfurized syngas" 14 describes the syngas after the sulfur is removed to a very low level (such as <5 or 1 ppm) desired by down stream syngas using units in the acid gas removal unit 10. Desulfurized syngas 14, as used herein, may, depending on the embodiment, also refer to a mixture of desulfurized syngas and refinery purge gas.

As used herein, the term "hydrocarbon synthesis unit" 20 describes various processes known to one skilled in the art for converting syngas into synthetic petroleum products. Typical processes are, but are not limited to, Fischer-Tropsch (F-T) or chain growth reaction of carbon monoxide and hydrogen on the surface of a heterogeneous catalyst. Hydrocarbon synthesis units may comprise various sub-parts, such as a gas to liquid reaction zone, liquid/vapor separation zone, product hydrocracking units, and product fractionators.

As used herein, the term "petroleum refinery" 30 refers to oil refinery processes known to one skilled in the art for converting crude hydrocarbon mixtures 32 into refinery products 34. Relevant unit operations in the petroleum refinery 30, emphasized for the objectives of this invention, are petroleum refinery hydroprocessing unit 36, which include hydrotreators and hydrocrackers wherein the hydrocarbon mixtures 32 are heated in the presence of an excess of an excess of hydrogen to effect the desired upgrading reactions. Because the petroleum refinery hydroprocessing units 36 operate with an excess of hydrogen, significant hydrogen must be fed to the process via a primary make up hydrogen feed 33.

As used herein, the term "refinery purge" 38 describes the purge gas typically, but not necessarily, comes from the petroleum refinery hydroprocessing units 36. Refinery processes operate with an excess of hydrogen in the petroleum refinery hydroprocessing units 36. A refinery purge removes inerts that build up in the petroleum refinery hydroprocessing units 36 to maintain the desired hydrogen concentration. The refinery purge gas 38 of one preferred embodiment contains more hydrogen than the raw syngas 8, and more preferably contains greater than 80 mole percent hydrogen, and even more preferably greater than 90 mole percent hydrogen. Furthermore, the refinery purge gas 38 of one preferred embodiment is at pressures higher than about 50 bar, which is high enough to send through processing equipment and still feed a hydrocarbons synthesis unit 20 without the need for compression. However, other embodiments may use refinery purge gas 38 of a lower pressure if the stream pressure is raised by compression (not shown).

As used herein, the term "utilities generation unit" 40 describes a process or unit that produces steam (STM) or power (PWR). One preferred utilities generation unit is a "combined cycle" unit that burns a fuel stream and uses both gas and steam turbine cycles in a single plant to produce electricity and steam with high conversion efficiencies and low emissions. However, the utilities generation unit can be any process known to one skilled in the art, such as a simple boiler, that converts a fuel stream into steam or power.

As used herein, the term "PSA unit" 50 describes a process or unit that separates desired gases from feedstreams by a process known as pressure swing adsorption. One skilled in the art is familiar with the use of PSA units for separating hydrogen from a hydrogen-containing stream. The PSA unit 50 of the current invention separates the hydrogen to create a substantially pure H2 stream 52, which is subsequently becomes refinery make-up H2 feed 54. The substantially pure H2 stream 52 of the current invention is greater than about 95 mole percent hydrogen, preferably greater than about 99 mole percent hydrogen, and even more preferably about 99.9 mole percent hydrogen. The PSA unit 50 also produces a combustible tail gas 56. The combustible tail gas 56 that comprises primarily CO, carbon dioxide (CO2), and methane that can be burned in the utility generation unit 40.

As used herein, the term "syngas membrane separator" 60 describes a device which provides the separation of H2 from a gaseous feedstream. The hydrogen is separated by preferential permeation of H2 over CO or CO2 or any other ordinary gases encountered in a refinery or syngas plant. Any type of membrane materials favorable to the separation of H2 and CO/CO2 known to one skilled in the art are acceptable. Any type of construction for membrane separators may be used, although hollow-fiber type is preferred for its compactness and high separation efficiency.

As used herein, the term "intermediate product stream" describes any of the streams between the integrated units described in this application.

As used herein, the term "desired product" describes a synthetic hydrocarbon product 22 produced in a synthesis gas unit 20, a refinery product 34 produced in a petroleum refinery 30, or both.

Referring to FIG. 1, one preferred embodiment of the invention comprises the steps of supplying a raw syngas 8, preferably from a refinery low-value stock, such as petcoke 4, taking a H2-containing refinery purge stream 38 from one or more hydroprocessing units 36 of a refinery 30. The purge stream is sent to an acid gas removal unit 10 to be combined with the raw syngas from the gasfier and desulfurized. The acid gas removal unit 10 strips out contaminants, typically contaminants, to form a desulfurized syngas 14. The desulfurized syngas 14 is then split into a first portion of desulfurized syngas 16 and a second portion of desulfurized syngas 18. The first portion of desulfurized syngas 16 is fed to a membrane separator 60 to form an H2-enriched permeate stream 62 and an H2-lean retentate stream 64. The H2-enriched permeate stream 62 is then split into a first portion of H2-enriched permeate stream 66 and a second portion of H2-enriched permeate stream 68. The first portion of H2-enriched permeate stream 66 is then added to the second portion of desulfurized syngas 18 to form a H2-enriched syngas 19 that has a H2CO or (H2−CO2)/(CO+CO2) ratio required by the liquid hydrocarbon synthesis system (GTL). The H2-enriched syngas 19 is then fed to a hydrocarbon synthesis unit 20 to produce synthetic hydrocarbon product 22. The second portion of H2-enriched permeate stream 68 is fed to a PSA unit 50, which then separates the stream into a substantially pure H2 stream 52 and a combustible tail gas 56. The substantially pure H2 stream 52 is sent to the petroleum refinery hydroprocessing unit 36 for use as make-up hydrogen. The H2-lean retentate stream 64 from the syngas membrane separator 60 and the combustible tail gas 56 from the PSA unit are fed to a utilities generation unit 40 to generate power and/or steam 42.

Again referring to FIG. 1, one preferred embodiment of the current invention includes, but is not limited to, a hydrocarbon synthesis unit 20 that comprises a GTL unit 24 coupled to a hydrocracker (HCR) unit 26. However, the hydrocarbon synthesis unit 20 of the current invention can be one of a variety of processes, such as a methanol unit or Fischer-Tropsch process, known by one skilled in the art to convert syngas into synthetic hydrocarbon product 22.

Referring again to FIG. 1, the refinery purge gas 38 in one preferred embodiment is combined with the raw syngas 8 in the acid gas removal unit 10. However, the two streams can also be combined upstream of the acid gas removal unit 10, in other equipment, by bringing the flows together into a common line, or any other method know to one skilled in the art.

Still referring to FIG. 1, the acid gas removal unit 10 strips out sulfur bearing compounds and other contaminates to form a desulfurized syngas 14. Because the refinery purge gas 38 contains more hydrogen than the raw syngas 8, the resultant desulfurized syngas 14 is higher in hydrogen content than the raw syngas 8. The desulfurized syngas 14 of one preferred embodiment has an H2/CO ratio of greater than about 1.0, more preferably greater than about 1.5, and even more preferably greater than about 1.9 or 2.0.

Again referring to FIG. 1, the first portion of desulfurized syngas 16 is fed to a syngas membrane separator 60 to form an H2-enriched permeate stream 62 and an H2-lean retentate stream 64. The H2-enriched permeate stream 62 comprises greater than about 60 mole percent hydrogen, more preferably greater than about 75 mole percent hydrogen, and even more preferably greater than about 90 mole percent hydrogen. The H2-enriched permeate stream 62 exits the syngas membrane separator 60 at a substantially reduced pressure due to passing through the membrane. In one preferred embodiment, the pressure is still high enough to feed the hydrocarbon synthesis unit 20. In other embodiments, compression and/or heating of the H2-enriched permeate stream 62 by means known to one skilled in the art may be required.

The H2-lean retentate stream 64 of FIG. 1, the non-permeated stream, contains CO, CO2, some amount of hydrogen, and other hydrocarbons, such as CH4, C2H6, and C3H8, all of which can be burned in various power and utility generation facilities. Furthermore, the pressure of the H2-lean retentate stream 64 in a preferred embodiment is greater than about 10 barg, and even more preferably about 20 barg. Thus, further energy can be extracted from the H2-lean retentate stream 64 by using expansion turbines (not shown) in the H2-lean retentate stream 64 line feeding the utilities generation unit 40.

Still referring to FIG. 1, the first portion of H2-enriched permeate stream 66 is split from the H2-enriched permeate stream 62 at an effective rate to combine with the second portion of desulfurized syngas 18 to form a H2-enriched syngas 19 with the proper H2/CO or (H2−CO2)/(CO+CO2) ratio required for feeding the hydrocarbon synthesis unit 20. In one preferred embodiment, the hydrogen-enriched syngas 19 has an H2/CO ratio of greater than about 1.5, more preferably an H2/CO of greater than about 1.9 and even more preferably about 2.0. One skilled in the art can determine the effective rate of H2-enriched permeate stream 62 required to achieve desired H2/C2 ratios based on mass balance simulations without undue experimentation.

The second portion of H2-enriched permeate stream 68 of FIG. 1 feeds a PSA unit 50. The PSA unit 50 separates the hydrogen from the second portion of H2-enriched permeate stream 68 to create a substantially pure H2 stream 52, that is subsequently used as refinery make-up H2 feed 54. The substantially pure H2 stream 52 of the current invention is greater than about 95 mole percent hydrogen, preferably greater than about 99 mole percent hydrogen, and even more preferably about 99.9 mole percent hydrogen. The effective feed rate of the second portion of H2-enriched permeate stream 68 to the PSA unit 50, and the proper size of the PSA unit can be determined by one skilled in the art to produce the desired flow rate of refinery make-up H2 feed 54 without undue experimentation. The PSA unit 50 also produces a combustible tail gas 56. Optionally, the H2-enriched permeate stream 68 can be directly sent to hydroprocessing units as a make-up gas, without using a PSA unit.

Referring again to FIG. 1, the H2-lean retentate stream 64 and the combustible tail gas 56 contain CO, CO2, some hydrogen, and other volatile hydrocarbons. These streams make good fuels, particularly for combustion turbines in the utilities generation unit 40. Removal of H2 increases the energy density of the stream. Any of a variety of power or steam generation systems known to one skilled in the art may be used to extract the residual energy from the H2-lean retentate stream 64 and the combustible tail gas 56 streams. A preferred utilities generation unit 40 is a combined cycle type unit wherein maximum energy can be extracted from the feedstreams by advantageous use of expander turbines, combustion turbines and steam-driven turbines to generate power. In another embodiment, an expander turbine (not shown) is used to extract the energy from the higher-pressure H2-lean retentate stream 64 individually from the combustible tail gas 56 before the streams are combined and fed to the utilities generation unit 40. Another embodiment would use a steam generating system that would burn the streams to produce steam needed for other processes.

In one embodiment shown in FIG. 1, an HCR purge gas 28 from the hydrocarbon synthesis system's hydrocracking unit 26, is combined with the first portion of desulfurized syngas 16 to form a membrane feed 17 that is higher in hydrogen content than the desulfurized syngas 14. In this embodiment, the hydrocarbon synthesis unit 20 comprises a GTL unit 24 and a hydrocracker unit 26. Like a petroleum refinery hydroprocessing unit, the hydrocracker unit 26 operates with an excess of hydrogen and requires a purge stream to keep the hydrogen concentration at desirable levels. Integrating the hydrocarbon synthesis unit 20 with the syngas membrane separator 60 and the syngas process allows for efficient recovery of the contained hydrogen in the HCR purge gas 28.

In one embodiment shown in FIG. 1, the substantially pure H2 stream 52 is split into a refinery make-up H2 feed 54 and a synthesis feed H2 58. The synthesis feed H2 58 is then fed to the desulfurized syngas 18 to further raise the H2/CO ratio of the H2-enriched syngas 19 by combining the synthesis feed H2 58 with the H2-enriched permeate stream 68, or by feeding the synthesis feed H2 58 directly (not shown) into the H2-enriched syngas 19.

In another alternate embodiment shown in FIG. 1, the substantially pure H2 stream 52 is split into a synthesis feed H2 58 and a refinery make-up H2 feed 54. The synthesis feed H2 58 is then fed to a hydrocracker unit 26 contained as part of the hydrocarbon synthesis unit 20.

In yet another alternate embodiment, the synthesis feed H2 58 is fed to both the desulfurized syngas 18 and the hydrocracker unit 26. The substantially pure H2 stream 52 that is not consumed as the synthesis feed H2 58 becomes refinery make-up H2 feed 54, which is combined with the refinery H2 feed 33 to supply the petroleum refinery hydroprocessing unit 36 with required hydrogen.

In another alternate embodiment of FIG. 1, the raw syngas 8 is provided by a gasifier 2. The gasifier 2 comprises any of a variety of processes known to one skilled in the art that produces a stream comprising predominantly of hydrogen (H2) and carbon monoxide (CO). One preferred gasifying process feeds a carbonaceous feed 4 comprising feedstocks of poor quality crude, coal, pet coke, or refinery residuals, and an oxygen feed 6 to the gasifier 2 to convert the feedstock into raw syngas 8.

In yet another alternate embodiment of FIG. 1, the process is integrated such that the petroleum refinery hydroprocessing unit 36, hydrocarbon synthesis unit 20, utilities generation unit 40, and gasifier 2 are located in close mutual proximity such that the process directly transfers the streams described above between units, typically by conduit or pipeline, such that there is no transferring of the intermediate product via transportation vehicles. Some alternate embodiments may include intermediate storage (not shown) to provide maximum efficiency and independent start-up and operation of the various units.

Figure 2:
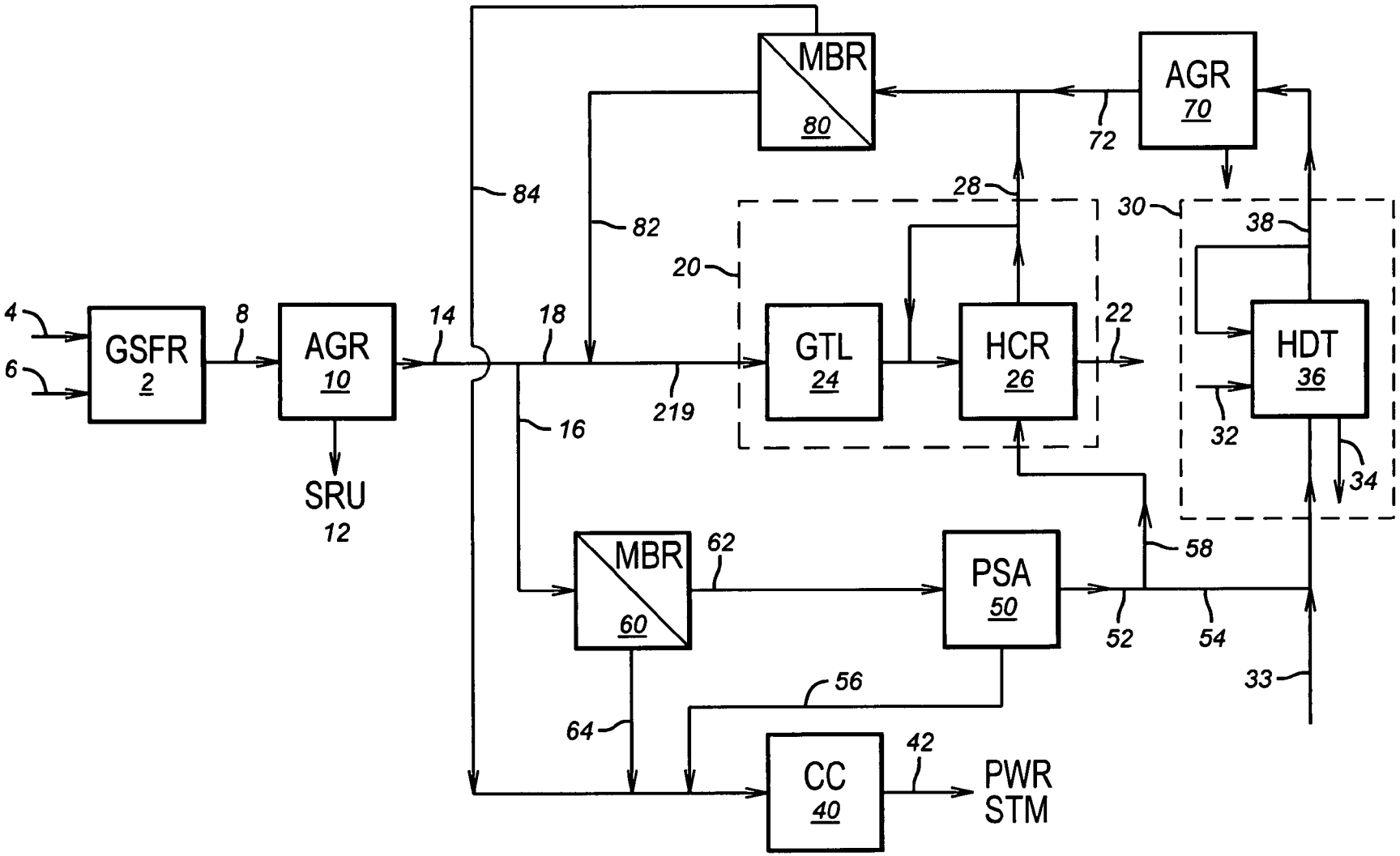
FIG. 2 is a diagram of an alternate embodiment of the current invention using two AGR units and two membrane separators.

Referring to FIG. 2, one preferred embodiment of the current invention includes generating a raw syngas 8 from a refinery low-value stock 4, such as petcoke, and increasing the hydrogen content of the desulfurized syngas 14 by adding hydrogen extracted from a refinery purge gas 38 of one or more hydroprocessing units 36 of a refinery 30. The refinery purge stream 38 is desulfurized in a refinery acid gas removal unit 70, and sent to a supplemental membrane separator 80 to produce two streams, a supplemental H2-enriched permeate stream 82 and a supplemental H2-lean retentate stream 84. The supplemental H2-enriched permeate stream 82 is added to the desulfurized syngas 14, thus supplying syngas with a desired H2/CO ratio to a hydrocarbon synthesis unit 20. The effective amount of refinery purge stream 38 is determined such that a desired H2/CO ratio or a (H2−CO2)/(CO+CO2) ratio is achieved in the combined H2-enriched synthesis feed 219 through the addition of H2 from the supplemental H2-enriched permeate stream 82. The H2/CO ratio of the combined H2-enriched synthesis feed 219 is greater than about 1.0, and preferably greater than about 1.9.

Referring again to FIG. 2, one optional embodiment further comprises combining an HCR purge gas 26 from the hydrocracker 26 of the hydrocarbon synthesis unit 20 with the desulfurized refinery purge gas 72, followed by the hydrogen separation in the supplemental membrane separator 80 to produce the supplemental H2-enriched permeate stream 82 and the supplemental H2-lean retentate stream 84 as described above.

Still referring to FIG. 2, optionally, a syngas membrane separator 60 and a PSA unit 50 can be utilized to produce a substantially pure H2 stream 52 by treating a first portion of desulfurized syngas 16 taken from the desulfurized syngas 14. The retentate stream of syngas membrane separator 60 (referred to as the H2-lean retentate stream 64), and the tail-gas from PSA unit 50 (referred to as the combustible tail gas 56), are routed to the utilities generation unit 40 for utility generation. The substantially pure H2 stream 52 then supplies refinery make-up H2 feed 54 to any petroleum refinery hydroprocessing unit in the petroleum refinery 30.

In one alternate embodiment shown in FIG. 2, the substantially pure H2 stream 52 is divided into a refinery make-up H2 feed 54 and an HCR H2 feed 59 to supply petroleum refinery hydroprocessing units 36 in the petroleum refinery 30 and/or the hydrocracker unit 26 of the liquid synthesis unit 20 respectively.

The supplemental H2-lean retentate stream 84 of FIG. 2 is fed to the utilities generation unit 40 to generate steam and/or power. One preferred embodiment includes an expansion turbine (not shown) to extract the energy contained in the pressure of the supplemental H2-lean retentate stream 84 before it is combined with the H2-lean retentive gas 64 from the syngas membrane separator 60.

Again referring to FIG. 2, the refinery acid gas removal unit 70 is of the type known to one skilled in the art. It is located either in the petroleum refinery 30, or between the petroleum refinery 30 and the hydrocarbon synthesis unit 20. The supplemental membrane separator 80 is any type that provides the preferential permeation of H2 over methane (CH4). Any type of membrane materials favorable to the separation of H2 and CH4 known to one skilled in the art are acceptable. Any type of construction for membrane separators may be used, although hollow-fiber type is preferred.

Figure 3:
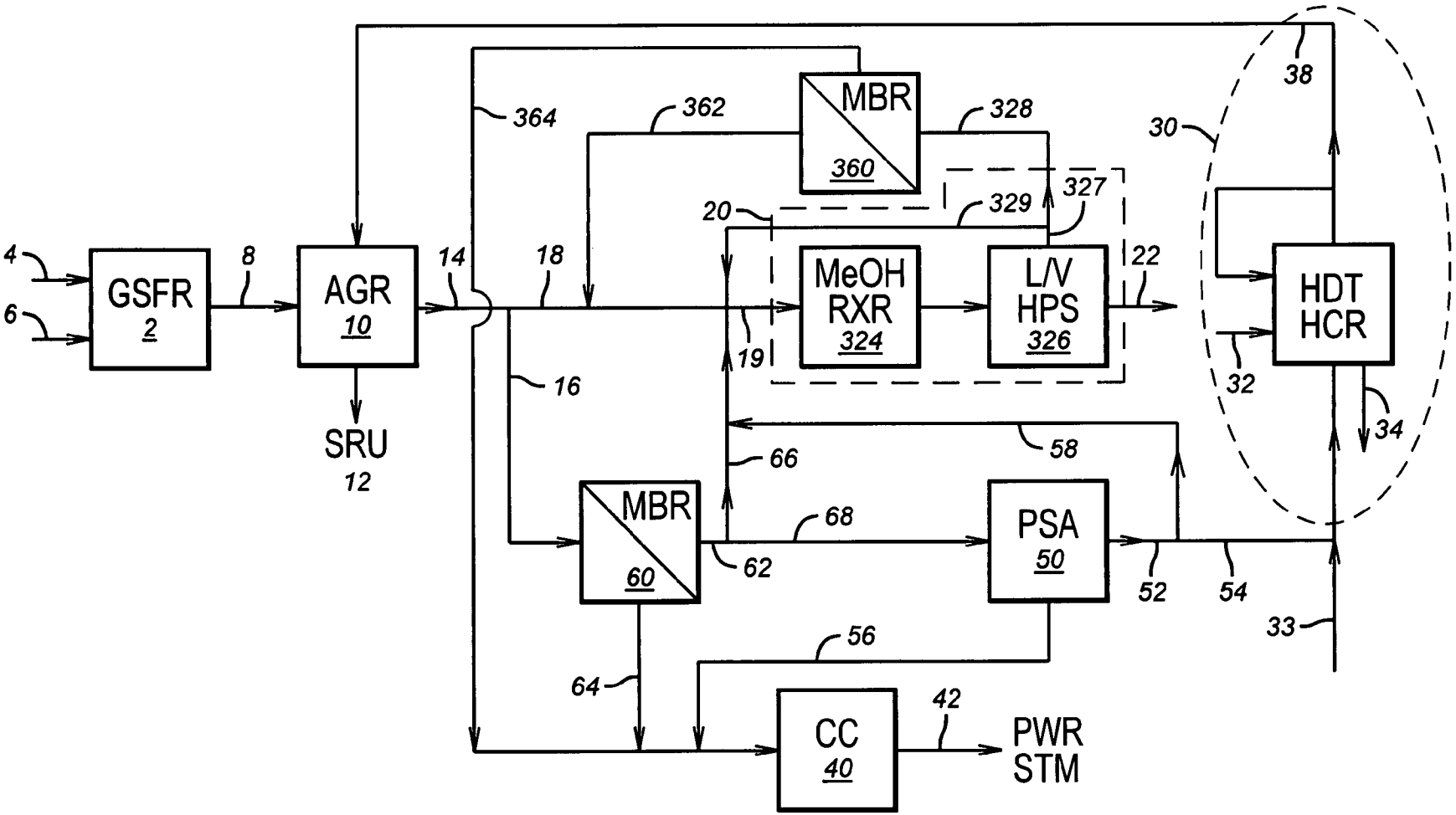
FIG. 3 is a diagram of an alternate embodiment of the current invention integrated with a methanol synthesis unit.

The preferred embodiment of FIG. 3, like the embodiment of FIG. 1, comprises the steps of supplying a raw syngas 8 and a refinery purge gas 38 to an acid gas removal unit 10. The acid gas removal unit 10 strips out sulfur bearing compounds to form a desulfurized syngas 14. The desulfurized syngas 14 is then split into a first portion of desulfurized syngas 16 and a second portion of desulfurized syngas 18. The first portion of desulfurized syngas 16 is fed to a syngas membrane separator 60 to form an H2-enriched permeate stream 62 and an H2-lean retentate stream 64. The H2-enriched permeate stream 62 is then split into a first portion of H2-enriched permeate stream 66 and a second portion of H2-enriched permeate stream 68. The first portion of H2-enriched permeate stream 66 is then added to the second portion of desulfurized syngas 18 at an effective rate to form a H2-enriched syngas 19 with a desired H2/CO or (H2−CO2)/(CO+CO2). The H2-enriched syngas 19 has an H2/CO ratio of greater than about 1.5, more preferably an H2/CO of greater than about 1.9 and even more preferably about 2.0. One skilled in the art can determine the effective rate of the first portion of H2-enriched permeate stream 66 required to achieve desired H2/C2 ratio for feeding the synthetic hydrocarbons unit 20 based on mass balance simulations without undue time and experimentation.

Still referring to FIG. 3, the H2-enriched syngas 19 is fed to a hydrocarbon synthesis unit 20 to produce synthetic hydrocarbon product 22. The second portion of H2-enriched permeate stream 68 is fed to a PSA unit 50, which produces a substantially pure H2 stream 52 and a combustible tail gas 56. The substantially pure H2 stream 52 is sent to the refinery 30 for use in the refinery process. The H2-lean retentate stream 64 and the combustible tail gas 56 are fed to a utilities generation unit 40 to generate power and/or steam 42.

In a preferred embodiment of FIG. 3, the hydrocarbon synthesis unit 20 further comprises a methanol reaction section 324 and a liquid/vapor separation (LVS) section 326. Various processes known to one skilled in the art for the production of methanol may be used. A synthesis off-gas 327 is removed from the LVS section 326 of the hydrocarbon synthesis unit 20. The synthesis off-gas 327 has a hydrogen content that is higher than the desulfurized syngas 18, preferably greater than about 60 mole percent hydrogen. The synthesis off-gas 327 is sent to an off-gas membrane separator 360 that separates the stream into an H2-enriched permeate off-gas 362 and an H2-lean off-gas 364.

The off-gas membrane separator 360 of the above alternate embodiment comprises a H2 selective membrane and is any type that provides the preferential permeation of H2 over CO or carbon dioxide (CO2). Any type of membrane material favorable to the separation of H2 and CO/CO2 known to one skilled in the art is acceptable. Any type of construction for membrane separators may to used, although hollow-fiber type is preferred.

Referring again to FIG. 3, the H2-enriched permeate off-gas 362 of the above alternate embodiment is combined with the second portion of desulfurized syngas 18 to raise the H2 content, and thus the H2/CO ratio of that stream. The H2-lean off-gas 364 is routed to the utilities generation unit 40 to produce power and/or steam.

Still referring to FIG. 3, another alternate embodiment of the current invention further comprises splitting the synthesis off-gas 327 from the LVS section 326 into a first portion of synthesis off-gas 329 and a second portion of synthesis off-gas 328. The first portion of synthesis off-gas 329 is routed to the off-gas membrane separator 360, forming the H2-enriched permeate off-gas 362, while the second portion of synthesis off-gas 329 is routed the inlet of the methanol reaction section 324 to combine with the other streams to form the H2-enriched syngas 19.

In an alternate embodiment shown in FIG. 3, the substantially pure H2 stream 52 is split into a refinery make-up H2 feed 54 and a synthesis feed H2 58. The synthesis feed H2 58 is then fed to the desulfurized syngas 18 to further raise the H2/CO ratio of the H2-enriched syngas 19 by combining the synthesis feed H2 58 with the H2-enriched permeate stream 68, or by feeding the synthesis feed H2 58 directly (not shown) into the H2-enriched syngas 19.

In another alternate embodiment of FIG. 3, the raw syngas 8 is provided by a gasifier 2. The gasifier 2 comprises any of a variety of processes known to one skilled in the art that produces a stream comprising predominantly of hydrogen (H2) and carbon monoxide (CO). One preferred gasifying process feeds a carbonaceous feed 4 comprising feedstocks of poor quality crude, coal, pet coke, or refinery residuals, and an oxygen feed 6 to the gasifier 2 to convert the feedstock into raw syngas 8.

In one embodiment shown in FIG. 3, the invention comprises the steps of supplying a raw syngas 8 to an integrated hydrocarbon processing system comprising a petroleum refinery hydroprocessing unit 36, an acid gas removal unit 10, a utilities generation unit 40, and a syngas membrane separator 60. The process is integrated such that the petroleum refinery hydroprocessing unit 36, hydrocarbon synthesis unit 20, utilities generation unit 40, and gasifier 2 are located in close mutual proximity such that the process directly transfers the streams described above between units, typically by pipe, such that there is no transferring of the intermediate product via transportation vehicles. Some alternate embodiments may include intermediate storage (not shown) to provide maximum efficiency and independent start-up and operation of the various units.

Figure 4:
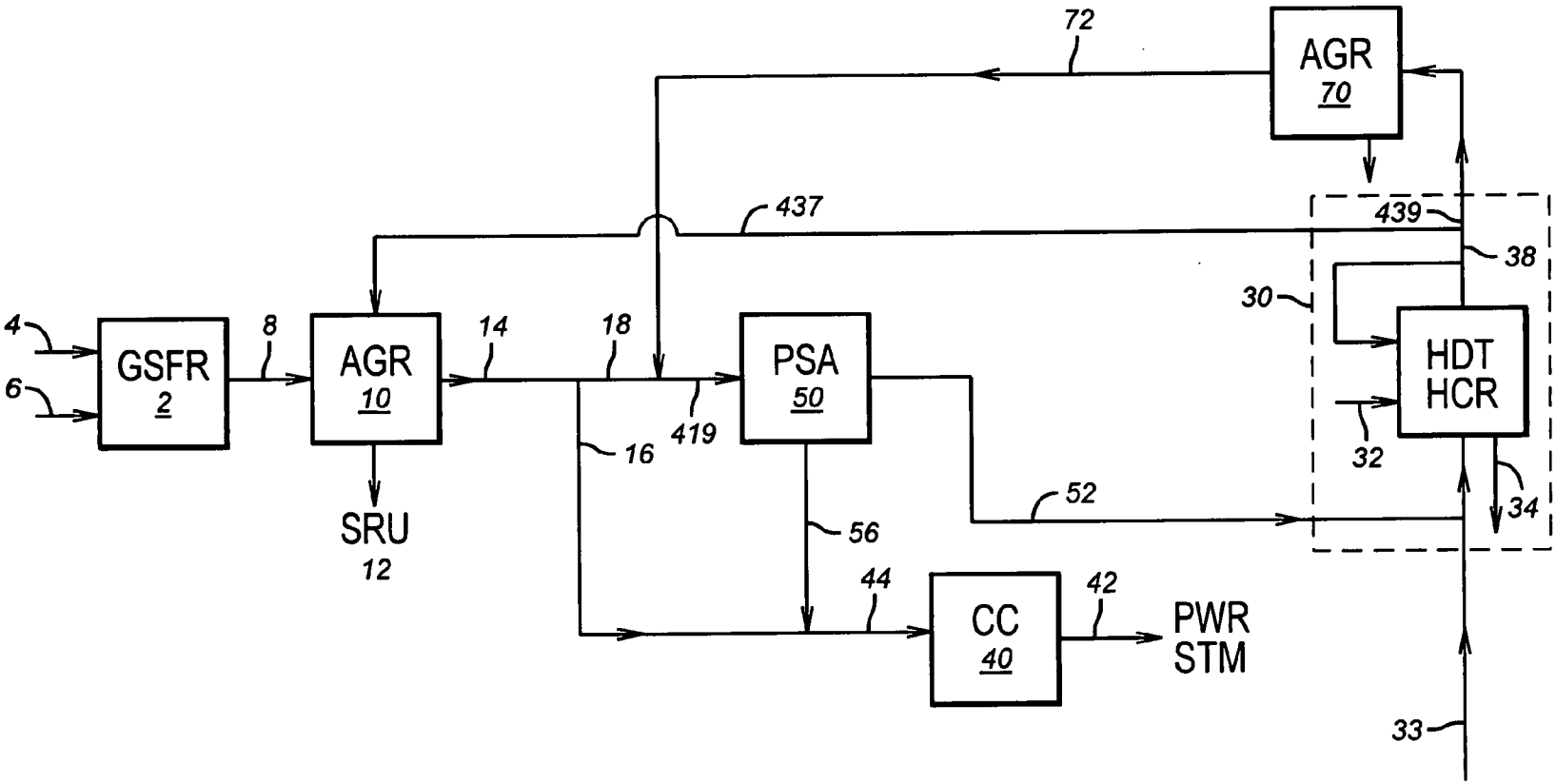
FIG. 4 is a diagram of an alternate embodiment of the current invention absent a hydrocarbon synthesis unit.

Referring to FIG. 4, one preferred embodiment of the invention comprises the steps of supplying a raw syngas 8 to an integrated hydrocarbon processing system comprising a hydrocarbon synthesis unit 20, a petroleum refinery hydroprocessing unit 36, an acid gas removal unit 10, a utilities generation unit 40, a PSA unit 50, and a syngas membrane separator 60. The petroleum refinery hydroprocessing unit 36, as with previous embodiments, produces a refinery purge gas 38, which is sent to the acid gas removal unit 10 to be combined with the raw syngas 8. As with other embodiments, the refinery purge gas 38 and the raw syngas 8 streams may be combined in the acid gas removal unit 10 or before the streams are fed to the removal unit. The acid gas removal unit 10 strips the sulfur and other contaminants from these two streams to form a desulfurized syngas 14. The desulfurized syngas 14 is split into a first portion of desulfurized syngas 16 and a second portion of desulfurized syngas 18. The first portion of desulfurized syngas 16 is fed to a utilities generation unit 40 to generate power and/or steam 42.

Still referring to FIG. 4, the second portion of desulfurized syngas 18 is fed to a PSA unit 50. The addition of refinery purge gas 38 to raw syngas 8 makes the H2 content of the desulfurized syngas 14 significantly higher than the raw syngas 8. The H2 content in the desulfurized syngas 14 is higher than 60 mole percent, more preferably higher than 70 mole percent, and even more preferably higher than 80 mole percent. The PSA unit 50 separates the stream into a substantially pure H2 stream 52 and a combustible tail gas 56. The substantially pure H2 stream 52 is sent to the petroleum refinery hydroprocessing unit 36 for use as make-up hydrogen. The combustible tail gas 56 from the PSA unit is combined with the first portion of desulfurized syngas 16 to form the utilities unit feed 44, which is then fed to a utilities generation unit 40 to generate power and/or steam 42.

In an alternate embodiment shown in FIG. 4, the integrated hydrocarbon processing system further comprises a refinery acid gas removal unit 70. In this embodiment, the refinery purge gas 38 is divided into a first portion of refinery purge gas 437 and a second portion of refinery purge gas 439. The first portion of refinery purge gas 437, is routed to the acid gas removal unit 10, for combining with the raw syngas 8 and formation of the desulfurized syngas 14. The second portion of refinery purge gas 439 is fed to a refinery acid gas removal unit 70. The refinery acid gas removal unit 70, as previously described in other embodiments, removes contaminants (typically sulfur bearing compounds) from the refinery purge gas to form a desulfurized refinery purge gas 72. The desulfurized refinery purge gas 72, which is rich in H2, is combined with the second portion of desulfurized syngas 18 to form a combined feed syngas 419. In this embodiment, the combined feed syngas 419 is then fed to a PSA unit 50. The addition of desulfurized refinery purge gas 72 to desulfurized syngas 18 further raises the H2 content of the combined feed syngas 419. The H2 content in the combined feed syngas 419 is higher than 60 mole percent, more preferably higher than 70 mole percent, and even more preferably higher than 80 mole percent. The PSA unit 50 separates the stream into a substantially pure H2 stream 52 and a combustible tail gas 56. The substantially pure H2 stream 52 is sent to the petroleum refinery hydroprocessing unit 36 for use as make-up hydrogen. The combustible tail gas 56 from the PSA unit is combined with the first portion of desulfurized syngas 16 to form the utilities unit feed 44, which is then fed to a utilities generation unit 40 to generate power and/or steam 42.

EXAMPLE

FIG. 2 is a block diagram of the process of the current invention using two AGR units and two membrane separators to effect one embodiment of the invention. Mass balance values corresponding to one embodiment of FIG. 2 are shown in Table I below.

TABLE 1

| Stream tag (FIG. 2) | 14 | 18 | 16 | 72 | 82 | 86 | 22 | 84 + 64 + 56 | air to CC(40) |
|---|---|---|---|---|---|---|---|---|---|
| Components | Composition (molar fraction) | | | | | | | | |
| O2 | 0.0000 | 0.0000 | 0.0000 | | 0.0000 | 0.0000 | 0.0000 | 0.0000 | 0.21 |
| CO | 0.4570 | 0.4570 | 0.4570 | 0.0001 | 0.0000 | 0.3169 | 0.0092 | 0.2087 | |
| CO2 | 0.0830 | 0.0830 | 0.0830 | 0.0000 | 0.0000 | 0.0576 | 0.0692 | 0.1631 | |

TABLE 1-continued

| Stream tag (FIG. 2) Components | 14 | 18 | 16 | 72 | 82 | 86 | 22 | 84 + 64 + 56 | air to CC(40) |
|---|---|---|---|---|---|---|---|---|---|
| | Composition (molar fraction) | | | | | | | | |
| H2 | 0.4330 | 0.4330 | 0.4330 | 0.8999 | 0.9923 | 0.6044 | 0.0010 | 0.3937 | |
| H2O | 0.0100 | 0.0100 | 0.0100 | 0.0000 | 0.0000 | 0.0069 | 0.0174 | 0.0037 | |
| N2 | 0.0000 | 0.0000 | 0.0000 | 0.0700 | 0.0000 | 0.0000 | 0.0000 | 0.0000 | 0.79 |
| CH4 | 0.0040 | 0.0040 | 0.0040 | 0.0200 | 0.0065 | 0.0048 | 0.0120 | 0.1236 | |
| C2H6 | 0.0000 | 0.0000 | 0.0000 | 0.0100 | 0.0009 | 0.0003 | 0.0177 | 0.0496 | |
| C3H8 | 0.0000 | 0.0000 | 0.0000 | | 0.0003 | 0.0001 | 0.0578 | 0.0341 | |
| I-C4 | 0.0000 | 0.0000 | 0.0000 | | 0.0000 | 0.0000 | 0.0000 | | |
| n-C4 | 0.0000 | 0.0000 | 0.0000 | | 0.0000 | 0.0000 | 0.0628 | 0.0092 | |
| I-C5 | 0.0000 | 0.0000 | 0.0000 | | 0.0000 | 0.0000 | 0.0000 | | |
| n-C5 | 0.0000 | 0.0000 | 0.0000 | | 0.0000 | 0.0000 | 0.0754 | 0.0046 | |
| nC6 | 0.0000 | 0.0000 | 0.0000 | | 0.0000 | 0.0000 | 0.0808 | 0.0018 | |
| nC7 | 0.0000 | 0.0000 | 0.0000 | | 0.0000 | 0.0000 | 0.0776 | 0.0006 | |
| nC8 | 0.0000 | 0.0000 | 0.0000 | | 0.0000 | 0.0000 | 0.0664 | 0.0002 | |
| nC9 | 0.0000 | 0.0000 | 0.0000 | | 0.0000 | 0.0000 | 0.0560 | | |
| nC10 | 0.0000 | 0.0000 | 0.0000 | | 0.0000 | 0.0000 | 0.0476 | | |
| nC11 | 0.0000 | 0.0000 | 0.0000 | | 0.0000 | 0.0000 | 0.0410 | | |
| nC12 | 0.0000 | 0.0000 | 0.0000 | | 0.0000 | 0.0000 | 0.0355 | | |
| nC13 | 0.0000 | 0.0000 | 0.0000 | | 0.0000 | 0.0000 | 0.0310 | | |
| nC14 | 0.0000 | 0.0000 | 0.0000 | | 0.0000 | 0.0000 | 0.0272 | | |
| nC15 | 0.0000 | 0.0000 | 0.0000 | | 0.0000 | 0.0000 | 0.0239 | | |
| nC16 | 0.0000 | 0.0000 | 0.0000 | | 0.0000 | 0.0000 | 0.0210 | | |
| nC17 | 0.0000 | 0.0000 | 0.0000 | | 0.0000 | 0.0000 | 0.0185 | | |
| nC18 | 0.0000 | 0.0000 | 0.0000 | | 0.0000 | 0.0000 | 0.0163 | | |
| nC19 | 0.0000 | 0.0000 | 0.0000 | | 0.0000 | 0.0000 | 0.0144 | | |
| nC20 | 0.0000 | 0.0000 | 0.0000 | | 0.0000 | 0.0000 | 0.0127 | | |
| nC21 | 0.0000 | 0.0000 | 0.0000 | | 0.0000 | 0.0000 | 0.0112 | | |
| nC22 | 0.0000 | 0.0000 | 0.0000 | | 0.0000 | 0.0000 | 0.0098 | | |
| nC23 | 0.0000 | 0.0000 | 0.0000 | | 0.0000 | 0.0000 | 0.0087 | | |
| nC24 | 0.0000 | 0.0000 | 0.0000 | | 0.0000 | 0.0000 | 0.0076 | | |
| nC25 | 0.0000 | 0.0000 | 0.0000 | | 0.0000 | 0.0000 | 0.0067 | | |
| nC26 | 0.0000 | 0.0000 | 0.0000 | | 0.0000 | 0.0000 | 0.0059 | | |
| nC27 | 0.0000 | 0.0000 | 0.0000 | | 0.0000 | 0.0000 | 0.0052 | | |
| nC28 | 0.0000 | 0.0000 | 0.0000 | | 0.0000 | 0.0000 | 0.0046 | | |
| nC29 | 0.0000 | 0.0000 | 0.0000 | | 0.0000 | 0.0000 | 0.0041 | | |
| nC30 | 0.0000 | 0.0000 | 0.0000 | | 0.0000 | 0.0000 | 0.0036 | | |
| C2H4 | 0.0000 | 0.0000 | 0.0000 | | 0.0000 | 0.0000 | 0.0055 | | |
| C3H6 | 0.0000 | 0.0000 | 0.0000 | | 0.0000 | 0.0000 | 0.0127 | | |
| 1-propene | 0.0000 | 0.0000 | 0.0000 | | 0.0000 | 0.0000 | 0.0076 | 0.0059 | |
| 1-hexene | 0.0000 | 0.0000 | 0.0000 | | 0.0000 | 0.0000 | 0.0048 | 0.0010 | |
| 1-butene | 0.0000 | 0.0000 | 0.0000 | | 0.0000 | 0.0000 | 0.0062 | | |
| Ar | 0.0130 | 0.0130 | 0.0130 | | 0.0000 | 0.0090 | 0.0035 | | |
| He | 0.0000 | 0.0000 | 0.0000 | | 0.0000 | 0.0000 | 0.0000 | | |
| Temperature © | 50 | 50 | 50 | 85 | 86 | 56 | 85 | 87 | 454 |
| Pressure (bar) | 25 | 25 | 25 | 50 | 25 | 25 | 24 | 23 | 18 |
| Flow (NM3/h) | 231,916 | 196,665 | 35,251 | 140,025 | 86,927 | 283,592 | 5,030 | 127,583 | 604,029 |
| Std ideal Lip vol flow (M3/h) | | | | | | | 39.3 | | |
| H2/CO | 0.95 | 0.95 | 0.95 | | | 1.91 | 0.10 | | |

Although the present invention has been described in considerable detail with reference to certain preferred versions thereof, other versions are possible. For example, where process streams are combined, such as the refinery purge gas and raw syngas streams, the combination can occur in specific equipment shown in preferred embodiments, such as the acid gas removal unit, or in piping, or in other process equipment not shown herein. Furthermore, separation membrane devices, petroleum refineries, hydrocarbon synthesis units and other units described herein may vary in construction. For example, one refinery may use equipment referred to as hydrocracker, whereas another may use a hydrotreator to effect the desired product production. There are also a variety of devices known in the art to construct and control the described devices. Therefore, the spirit and scope of the appended claims should not be limited to the description of the preferred versions contained herein.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A process for integrating a refinery hydroprocessing unit, with a syngas stream, a hydrocarbon synthesis unit, and a utilities generation unit, the process comprising the steps of:

(a) supplying a raw syngas comprising H2, (b) providing an integrated hydrocarbon processing system comprising:

(i) a hydrocarbon synthesis unit, (ii) a petroleum refinery hydroprocessing unit, which is operable to produce at least a refinery product and a refinery purge gas, (iii) an acid gas removal unit, (iv) a utilities generation facility, (v) a syngas membrane separator, and (vi) a PSA unit, (c) forming a desulfurized syngas by stripping contaminants from said raw syngas and said refinery purge gas in said acid gas removal unit, (d) separating in said syngas membrane separator a first portion of desulfurized syngas to form an H2-enriched permeate stream and an H2-lean retentate stream, (e) forming an H2-enriched syngas by combining a second portion of desulfurized syngas and a first portion of said H2-enriched permeate stream, wherein said H2-enriched syngas is formed with an effective H2/CO ratio for the production of synthetic hydrocarbon products, (f) producing a synthetic hydrocarbon product by feeding said H2-enriched syngas to said hydrocarbon synthesis unit, (g) charging a second portion of said H2-enriched permeate stream to said PSA unit, (h) obtaining a substantially pure H2 stream from said PSA unit, (i) producing a combustible tail gas from said PSA unit, (j) supplying said substantially pure H2 stream to said petroleum refinery hydroprocessing unit, and (k) feeding said combustible tail gas together with said H2-lean retentate stream to said utilities generation unit, so as to produce useful power and steam therefrom.

2. The process of claim 1, which further comprises feeding a purge gas obtained from said hydrocarbon synthesis unit to said syngas membrane separator.

3. The process of claim 1, which further comprises adding a first portion of substantially pure H2 stream from said PSA unit to at least one of:

(i) said first portion of H2-enriched permeate stream; and (ii) a hydrocracker unit of said hydrocarbon synthesis unit.

4. The process of claim 3, which further comprises the step of adjusting relative flow rates of:

(i) said first portion of substantially pure H2 stream to said first portion of H2-enriched permeate stream;

(ii) said first portion of substantially pure H2 stream to said hydrocracker; and (iii) a second portion of substantially pure H2 stream, wherein said second portion of substantially pure H2 stream is used as refinery make-up hydrogen feed;

effectively for forming desired products from said hydrocarbon synthesis unit and said petroleum refinery hydroprocessing unit.

5. The process of claim 3, wherein said H2-enriched syngas has an H2/CO ratio of greater than about 1.9.

6. The process of claim 3 in which said integrated hydrocarbon processing system further comprises a gasifier wherein a carbonaceous feed reacts with an oxygen stream to form said raw syngas.

7. The process of claim 6, in which the process steps occur absent transferring an intermediate product stream between integrated units via transportation vehicles.

* * * * *